US008109575B2

(12) United States Patent
Vitale

(10) Patent No.: US 8,109,575 B2
(45) Date of Patent: Feb. 7, 2012

(54) CONTOURED LOVESEAT

(76) Inventor: Anthony Vitale, San Rafael, CA (US)

( * ) Notice: Subject to any disclaimer, the term of this patent is extended or adjusted under 35 U.S.C. 154(b) by 35 days.

(21) Appl. No.: 12/315,094

(22) Filed: Nov. 28, 2008

(65) Prior Publication Data

US 2010/0133892 A1 Jun. 3, 2010

(51) Int. Cl.
*A47C 7/00* (2006.01)
*A47C 7/02* (2006.01)

(52) U.S. Cl. ..... 297/440.14; 297/195.11; 297/451.8; 128/845

(58) Field of Classification Search ..... 297/440.14, 297/440.15, 451.8, 195.11; 128/845
See application file for complete search history.

(56) References Cited

U.S. PATENT DOCUMENTS 3,606,461 A * 9/1971 Moriyama ..... 297/451.8 X
4,505,265 A * 3/1985 Cronenwett et al. ..... 128/845
6,454,358 B1 * 9/2002 Benincasa ..... 297/440.14
6,578,218 B2 * 6/2003 Wassilefsky ..... 5/648
7,347,493 B2 * 3/2008 Mulmed ..... 297/233

* cited by examiner

*Primary Examiner* — Anthony D Barfield
(74) *Attorney, Agent, or Firm* — Steven A. Nielsen; Allman & Nielsen, P.C.

(57) ABSTRACT

Contoured loveseat with an internal support frame forming an elongate rectilinear shape having a pair of matching long rigid parallel side panels, a pair of matching short rigid parallel side panels and a contoured top panel. The short side panels and the contoured top panels are covered by a uniformly thick cushion material. The short side panels join the top panel in a radiused fashion. A plurality of supplemental support cushions can be slidably retained within cutout portions in the side panels. The cutout portions are shaped to match the profile of the supplemental cushions. A preferred embodiment includes one side of the contoured top panel being sized for a male body and the opposite side of the contoured top panel being sized for a female body.

2 Claims, 5 Drawing Sheets

CONTOURED LOVESEAT

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sexual aid products and more specifically to a contoured loveseat.

Sexual intercourse and other sexually arousing activities between two adults have been known to be improved by the aid of supporting furniture or cushions that help the bodies be supported at an ideal height and angle. Each different sexual act requires its own intimate position which can be aided by a specifically shaped and cushioned support structure.

A number of novel support structures an cushions for aiding in sexual relations between two people have been described in prior art. Many of the designs involve specially designed adjustable chairs including patents:

U.S. Pat. No. 4,725,188
U.S. Pat. No. 5,385,154
U.S. Pat. No. 5,389,062
U.S. Pat. No. 5,453,080
U.S. Pat. No. 5,538,001

Others resemble bench type apparatus similar to what one might find in a fitness center, including patents:

D390,664
U.S. Pat. No. 5,443,532
U.S. Pat. No. 6,745,774
U.S. Pat. No. 6,698,431
application number 2003/0126686

Still other are designed as cushions without a rigid support structure including patents:

U.S. Pat. No. 4,987,625
U.S. Pat. No. 6,925,669

However, there is a deficiency in the prior technology in that none of the prior art shows a contoured loveseat that includes a the convenient storage of a plurality of support cushions within its frame. Additionally, none of the prior art shows a rectilinear design where one side of the loveseat is designed for a male body form and the opposite side of the loveseat is designed for a female body form. Furthermore, none of the prior art shows a contoured loveseat where the width of the seat is designed to allow an individual's legs to straddle the seat while in a prone position. Finally, none of the prior art shows a design that is aesthetically pleasing and looks at home at the foot of a bed in a standard bedroom.

BRIEF SUMMARY OF THE INVENTION

The primary object of the invention is to provide a contoured, cushion topped support bench for two human bodies that enhances the opportunities for a couple to experience a variety of intimate positions.

Another object of the invention is to provide a plurality of supplemental cushions that can be used in combination with the support bench.

Another object of the invention is to provide a convenient and decorative way of storing the supplemental cushions within the confines of the support bench.

A further object of the invention is to provide a contoured support bench where one side is designed to support a male human body and the opposite side is designed to support a female human body.

Yet another object of the invention is to provide a contoured support bench whose width is designed to allow a person's legs to straddle the bench.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a contoured loveseat comprising: an internal support frame forming an elongate rectilinear shape, a pair of matching long rigid parallel side panels, a pair of matching short rigid parallel side panels, a contoured top panel, said short side panels and said contoured top panel covered by a uniformly thick cushion material, said short side panels joining said top panel in a radiused fashion, a plurality of supplemental support cushions, said support cushions capable of being slidably retained within cutout portions in said side panels, and said cutout portions shaped to match the profile of said supplemental cushions.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
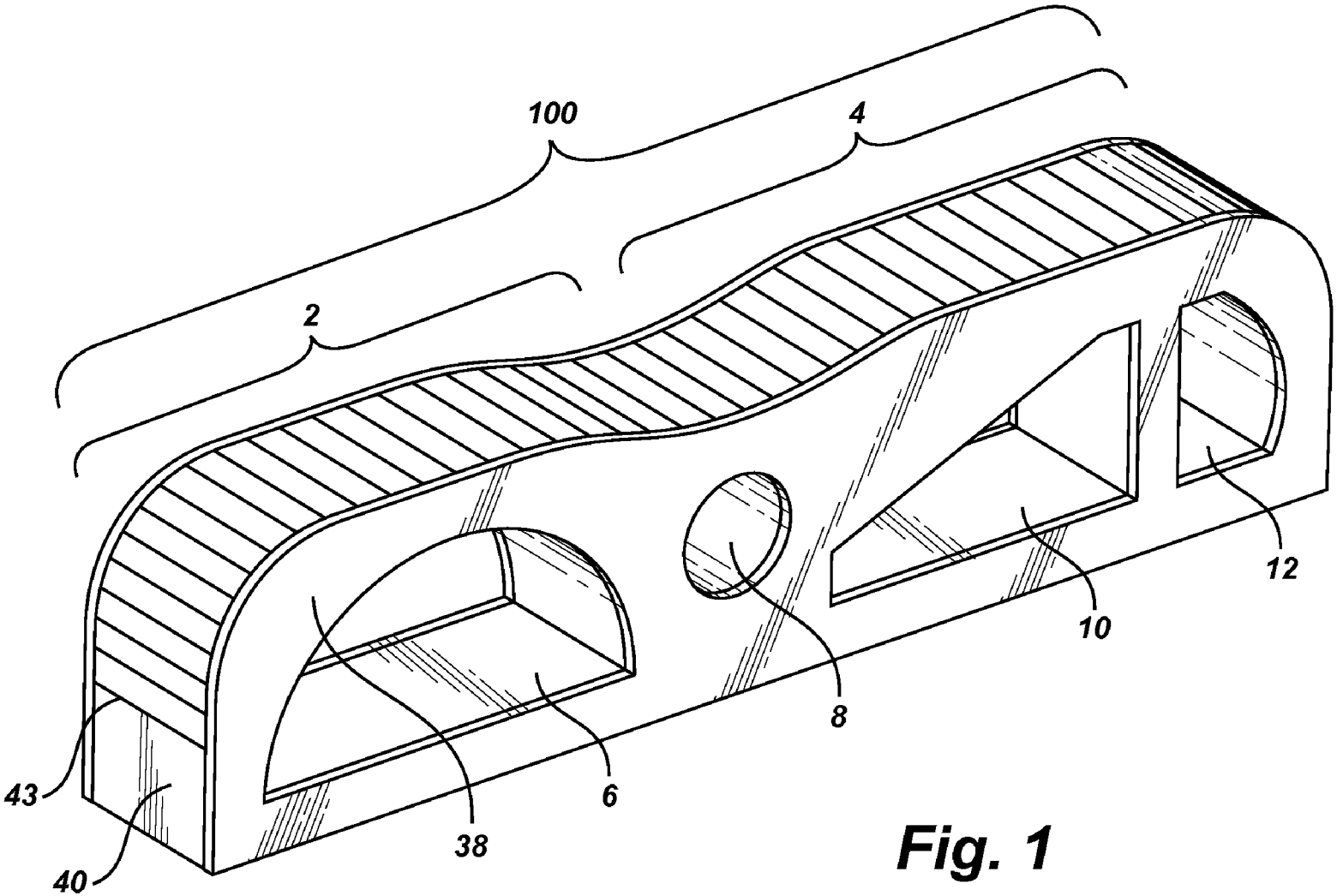
FIG. 1 is a perspective view of the invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

referring now to FIG. 1 we see a perspective view of the invention 100. The overall shape is basically rectilinear bench or loveseat design. The loveseat can support one or two human bodies during love making activities. The curvature of the top portion 2,4 enhances the opportunities for a couple to experience a variety of intimate positions. There are two parallel long sides 38, 39 and two parallel short sides 40, 41. A contoured top is comprised of a male side 2 and a female side 4. The male side is slightly lower and the female side is slightly higher as will be explained in more detail below. A plurality of supplemental cushions 6, 8, 10, 12 are stored within cutout portions in the side panel 38. The cutout portions match the shape of the cushions so the cushions are easy to install and remove. When the cushions are installed, they blend with the side panel so that the overall shape 100 looks like a modern piece of furniture that can easily blend with the decor of a person's bedroom or other personal space within a home, hotel, salon or office.

Figure 2:
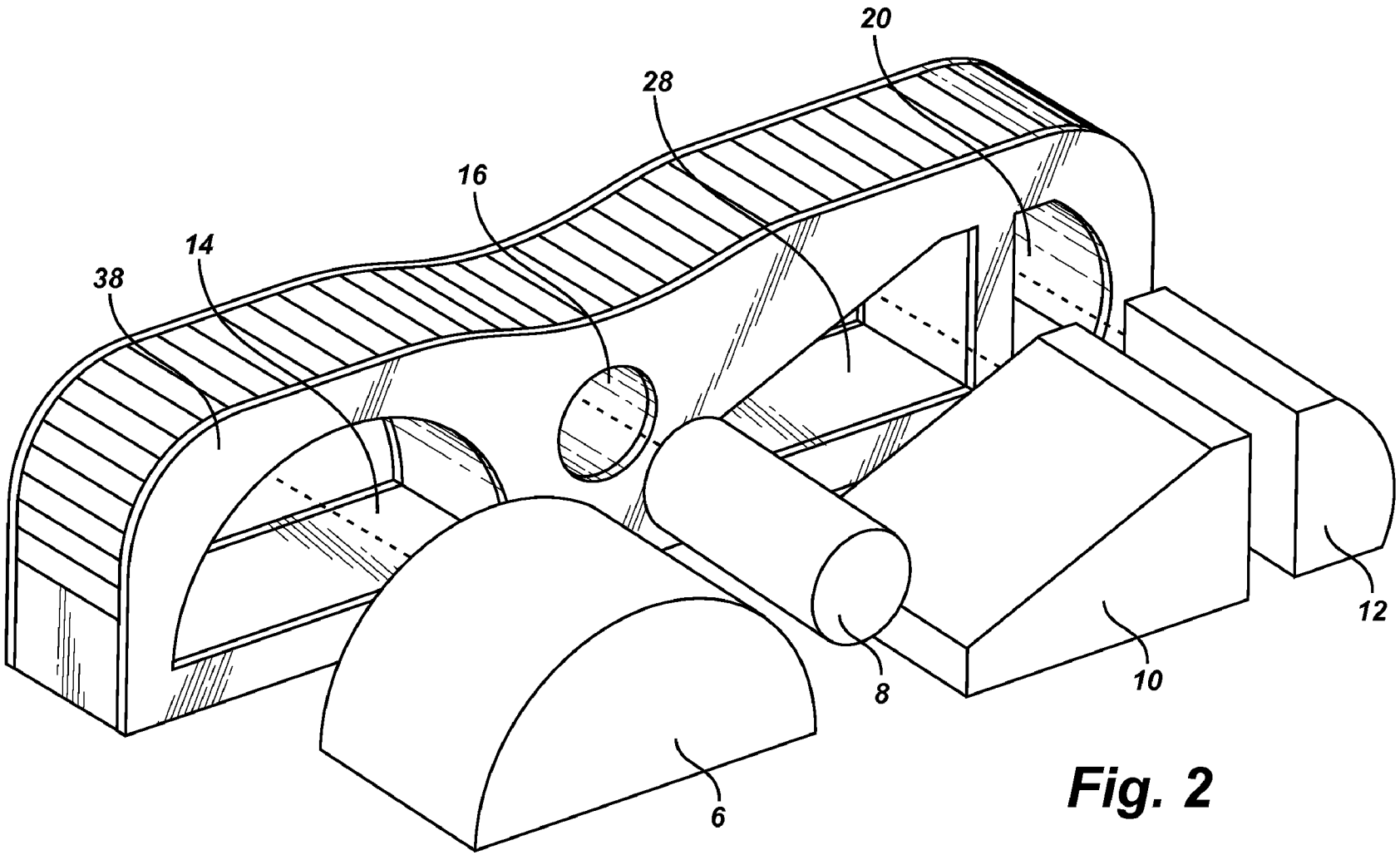
FIG. 2 is an exploded view of the invention where the supplemental cushions are removed from their housings within the contoured loveseat.

FIG. 2 shows an exploded view with the cushions 6, 8, 10, 12 removed from their storage spaces 14, 16, 18, 20 respectively. The cushions are made of polyfoam and covered with batting and upholstered in a washable fabric. The cushions 6, 8, 10, 12 are designed to be placed on the bench's contoured top surface 2, 4 to create additional opportunities to alter a couple's position. The semi-circular cushion 6 can be used to support a person who is leaning forward to enhance rear entry by their partner. The semi circular cushion 6 used in conjunction with the wedge cushion 10 can alter the height and angle of support of the bench top 2, 4. The semi-circular cushion 6 can be turned onto its curved surface and be used as a back support. The wedge shaped cushion 10 is also used as a back support. When turned on its angled surface it is useful in altering the pelvic angle of a person lying prone on the top surface 2, 4. The quarter circle cushion 12 can be used as a head support. When used in combination with the wedge cushion 10, it can alter the height and angle of the pelvis. Cylindrical cushion 8 can be used as a neck support. Alternately, cutout area 16 can be used to store a rolled up towel or folded sheets rather than storing cushion 8.

Figure 3:
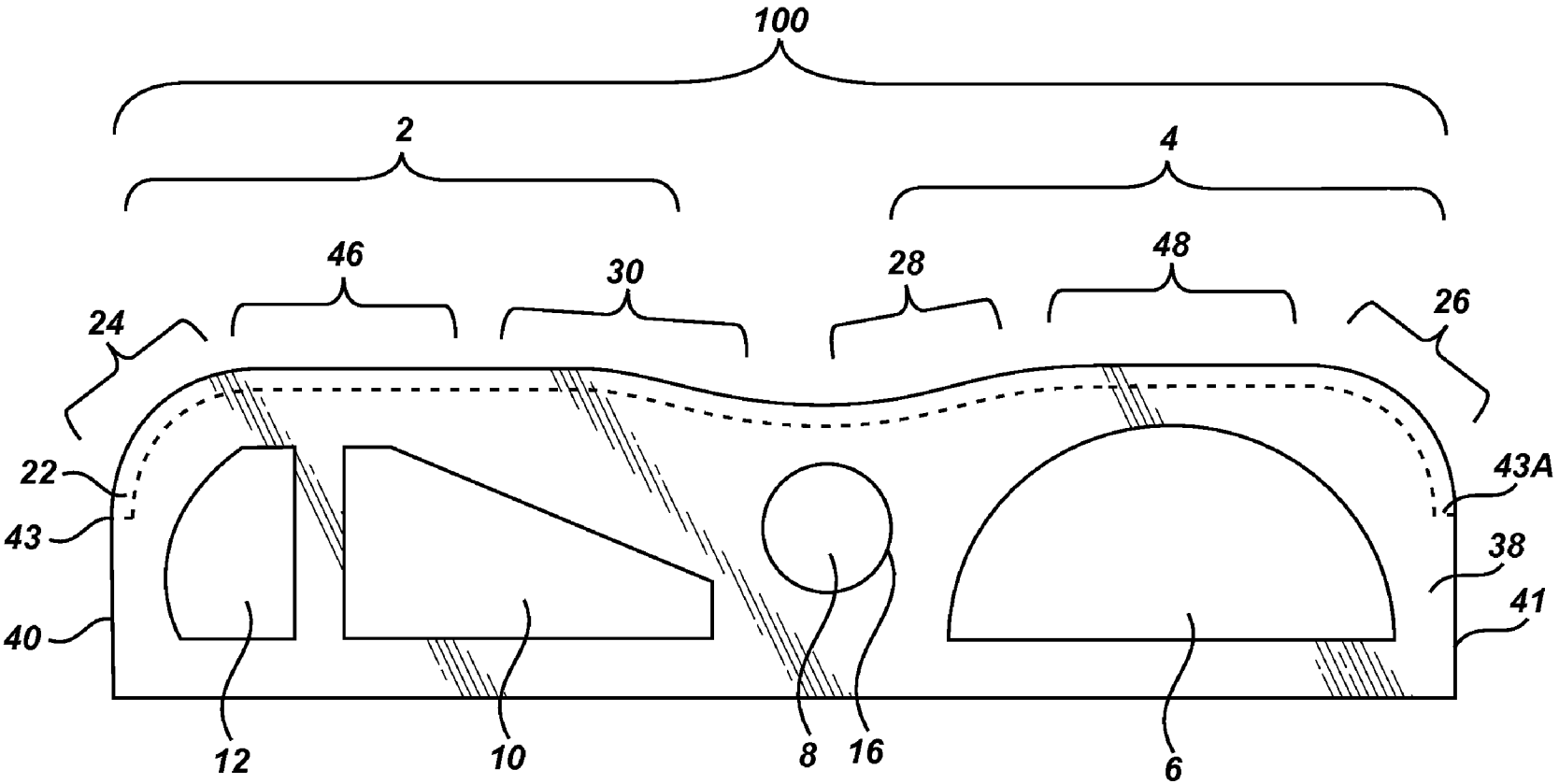
FIG. 3 is a front view of the invention

FIG. 3 shows a side view of the invention 100 with the cushions 6, 8, 10, 12, in place. Each portion of the contoured top is designed for a specific reason. The left side 2 is designed more for a male person. The right side 4 is designed for a female person. Flat portion 46 is longer than flat portion 48 to accommodate the longer male torso. Radiused portion 24 is smaller than radiused portion 26 because portion 24 is designed to allow a male's neck and head to tilt back, whereas portion 26 is designed for a female to be able to lean over when she is kneeling on the floor with her torso resting on flat surface 48. Downward sloping portion 30 is at less of a steep angle than downwardly sloping portion 28 because the lower back portion of a male needs less of a sloping angle, creating less of an arch, than the lower back portion of a female who needs more of an arch. bench side 4 is slightly taller than bench side 2. Contoured top 2, 4 and end panels 40, 41 are covered, as indicated by dotted line 22, with approximately two inches of polyfoam with an additional half inch layer of polybatten zipped into a washable muslin cover which is then zipped into a quality cushion cover. The cushion portion ends at horizontal lines 43, 43A. Hard panels approximately eight inches in height complete the end panels 40, 41.

Figure 4:
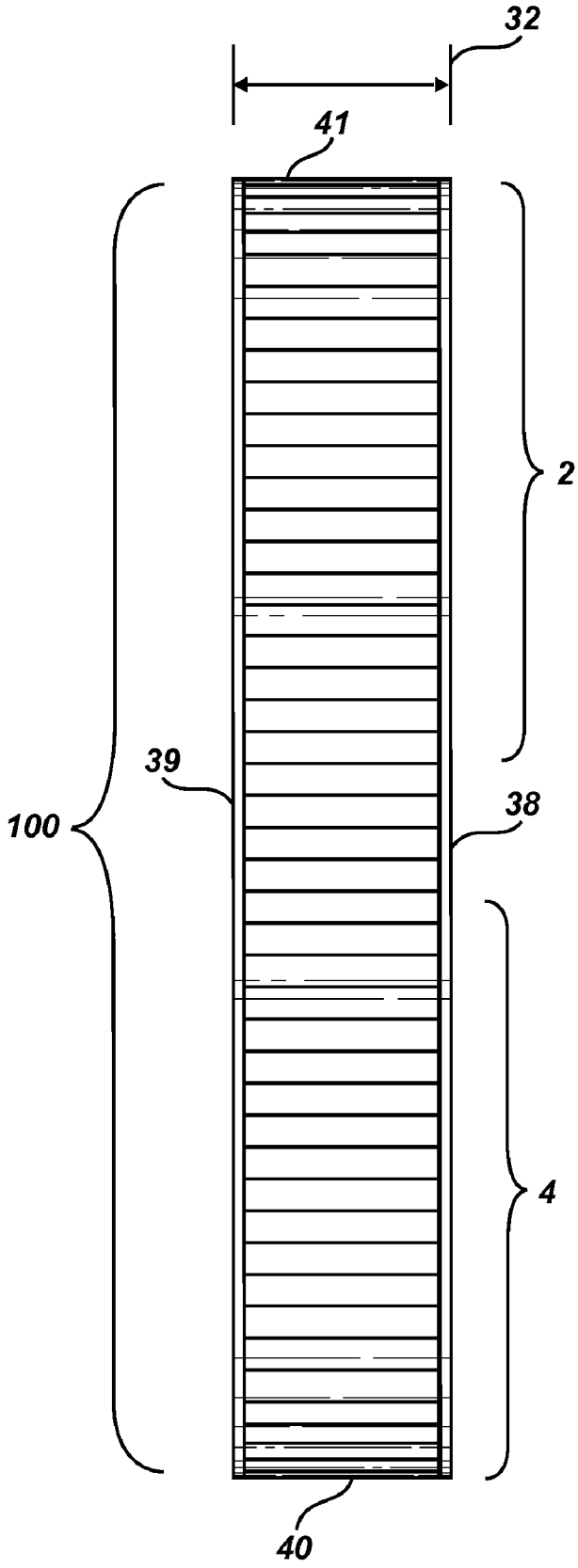
FIG. 4 is a top plan view of the invention.

FIG. 4 shows a top plan view of the invention 100. This view shows the basic rectilinear shape of the loveseat bench 100. Long sides 38, 39 are parallel and short sides 40, 41 are parallel. The width of the bench, as shown by dimension arrows 32 is approximately eleven inches, which allows a person's legs to comfortably straddle the bench while lying in a prone position or while in a sitting position. The overall length of the bench 100 is approximately seventy inches with the male side 2 being approximately thirty-eight inches long and the female side 4 being approximately thirty-two inches long.

Figure 5:
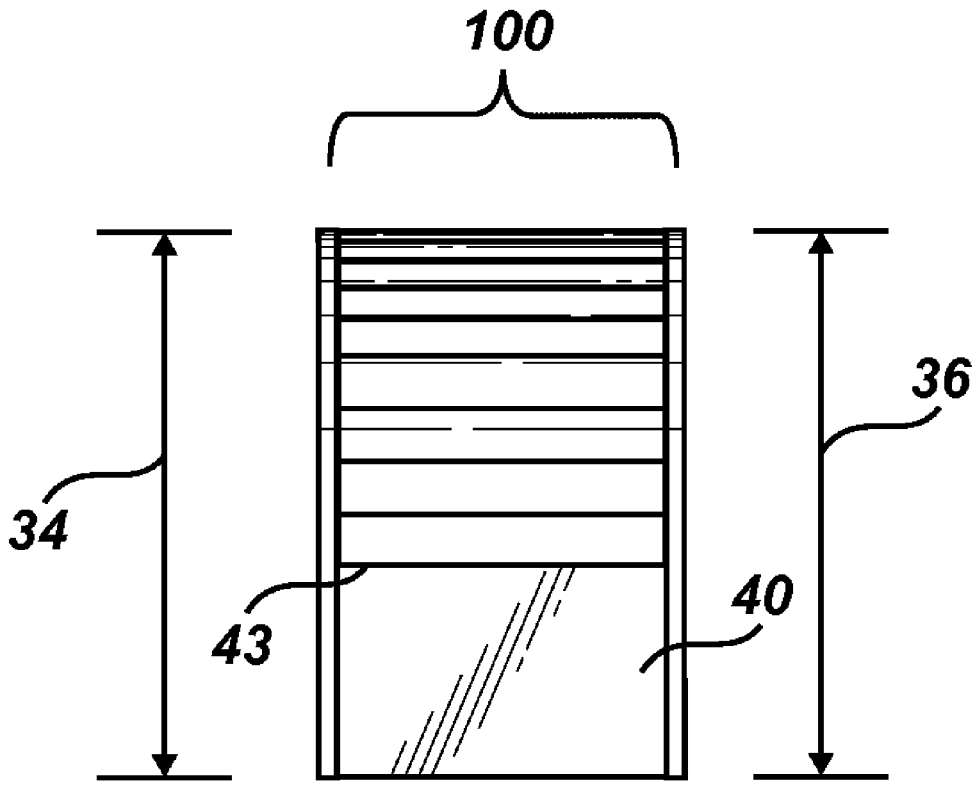
FIG. 5 is an end view of the invention.

FIG. 5 shows an end view of the invention 40. Dimension arrows 36 shows the height of the male side of the bench 10 and is approximately sixteen inches. Dimension arrows 34 shows the height of the female portion of the bench and is approximately seventeen inches.

The above description and drawings show that the present loveseat, bench is a novel and useful furniture product that can aid couples in the process of love making. The storage of supplemental cushions within the main structure of the bench is convenient and aesthetically pleasing so that the present invention will blend into a standard home living environment.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An asymmetrical contoured loveseat comprising:

an internal support frame forming an elongate rectilinear shape;

a pair of matching long rigid parallel side panels;

a pair of matching short rigid parallel side panels;

a contoured top panel comprising a lower male side and a taller female side separated by a downward sloping portion, such that the female side is higher in elevation as compared to the male side;

said short side panels and said contoured top panel are covered by a uniformly thick cushion material;

said short side panels joining said top panel in a radiused fashion;

a flat bottom side used to rest upon a floor and to support the long rigid parallel side panels and short rigid parallel side panels;

a plurality of supplemental support cushions, wherein the supplemental support cushions are in polygon shapes;

said supplemental support cushions capable of being slidably retained with cutout portions in said side panels;

said cutout portions of the side panels shaped to match the polygon shapes of said supplemental support cushions;

wherein the male side of said contoured top panel is proportioned for a male body and the female side is proportioned for a female body;

wherein the female side of the contoured top panel is raised above the male side of the contoured top panel;

wherein the male side of the contoured top panel is longer in length as compared to the female side of the contoured top panel; and wherein the width of said contoured loveseat is narrow enough to allow a person's legs to straddle said loveseat while sitting on either the male side or female side.

2. Contoured loveseat as claimed in claim 1 wherein said supplemental support cushions' polygon shapes include a semicircular cushion, a cylindrical cushion, a wedge shaped cushion and a quarter pie shaped cushion.

* * * * *